US007513131B2

(12) United States Patent
Kim

(10) Patent No.: US 7,513,131 B2
(45) Date of Patent: Apr. 7, 2009

(54) LID ASSEMBLY FOR WASHING MACHINE

(75) Inventor: Byung Chan Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 646 days.

(21) Appl. No.: 11/037,420

(22) Filed: Jan. 19, 2005

(65) Prior Publication Data

US 2006/0254323 A1 Nov. 16, 2006

(30) Foreign Application Priority Data

Jul. 19, 2004 (KR) ..... 10-2004-0056047

(51) Int. Cl.
*D06F 29/00* (2006.01)

(52) U.S. Cl. ..... 68/13 R; 220/810; 49/381; 49/501

(58) Field of Classification Search ..... 68/235 R, 68/196, 3 R, 235, 13 R; 134/183, 115 R, 134/200; 220/810–849; 49/381, 501
See application file for complete search history.

(56) References Cited

U.S. PATENT DOCUMENTS 5,103,993 A * 4/1992 Bingisser ..... 220/782
5,730,309 A * 3/1998 Jiradejnunt et al. ..... 220/276
5,906,116 A * 5/1999 Kim et al. ..... 68/53
6,282,927 B1 * 9/2001 Wunderlich et al. ..... 68/3 R
6,665,984 B2 * 12/2003 Bienick et al. ..... 49/501
2004/0200243 A1 * 10/2004 Cheo ..... 68/3 R

FOREIGN PATENT DOCUMENTS

JP 11-137500 * 5/1999

* cited by examiner

*Primary Examiner*—Michael Kornakov
*Assistant Examiner*—Stephen Ko
(74) *Attorney, Agent, or Firm*—Birch, Stewart, Kolasch & Birch, LLP

(57) ABSTRACT

A lid assembly for a washing machine is provided. The lid assembly is rotatably attached to a case of the washing machine so as to cover/uncover an opening for loading/unloading the laundry. The lid assembly includes an upper lid, a lower lid provided under the upper lid, and a hinge installed between the upper lid and the lower lid and rotatably connected to the case of the washing machine. The upper and lower lids and the hinge are securely fixed with a fixing member. The upper and lower lids disperse and absorb a shock generated when the lid assembly covers an opening of the case.

3 Claims, 7 Drawing Sheets

LID ASSEMBLY FOR WASHING MACHINE

This application claims the benefit of the Korean Application No. P2004-56047 filed on Jul. 19, 2004, which is hereby incorporated by reference.

BACKGROUND OF THE INVENTION

1. Field of the Invention

The present invention relates to a washing machine, and more particularly, to a lid assembly used for covering/uncovering an opening so as to load/unload the laundry in a washing machine.

2. Discussion of the Related Art

A washing machine is a typical home appliance which washes the laundry by using a detergent and water. The washing machine is classified into a top loading-type washing machine and a front loading-type washing machine according to loading positions of the laundry. In general, the front loading-type washing machine is constructed to include a horizontal drum for receiving the laundry, a plurality of lifters provided at an inner surface of the drum so as to repeatedly lift and then drop the laundry during the rotation of the drum, and a door provided at a front surface of the washing machine so as to cover/uncover the drum. Also, the top loading-type washing machine is constructed to include a vertical tub for receiving the laundry, a pulsater for washing the laundry during its rotation in the tub, and a lid provided at an upper surface of the washing machine so as to cover/uncover the tub.

In the meantime, the lid is attached to an upper case of the top loading-type washing machine by a hinge. However, the hinge is shocked whenever the lid is opened/closed. Accordingly, if the washing machine is used for a long time, the lid, especially the hinge, is broken.

SUMMARY OF THE INVENTION

Accordingly, the present invention is directed to a lid assembly for a washing machine that substantially obviates one or more problems due to limitations and disadvantages of the related art.

An object of the present invention is to provide an improved lid structure capable of making it possible to minimize a shock upon a hinge when a washing machine's lid is opened/closed.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lid assembly for a washing machine includes: an upper lid; a lower lid provided under the upper lid; and a hinge installed between the upper lid and the lower lid and rotatably connected to the case of the washing machine.

The upper lid and the lower lid may disperse and absorb a shock generated when the lid assembly covers an opening of the case. The lid assembly may further include windows formed in the upper lid and the lower lid.

The upper lid may include a rim extended downwardly from both sides of the upper lid; and at least one boss provided in the rim so as to receive a fixing member. The boss may include a recessed seat formed on an outer surface of the rim so as to receive a head of the fixing member. The upper lid may include a cut away portion provided at a side of the upper lid so that a part of the hinge is protruded toward an outside of the side of the upper lid. The upper lid may include at least one reinforcement rib provided at a lower surface of the upper lid so as to reinforcement strength of the upper lid. Further, the upper lid may include a stepped portion provided at a lower surface of one end of the upper lid so that a user is able to insert his fingers into the stepped portion.

The lower lid may include a hinge receiving portion provided at an upper surface of the lower lid so as to receive the hinge. The hinge receiving portion may include: a rib protruded from an upper surface of the lower lid and positioned spaced apart from a side of the lower lid by a given distance; and a projection protruded from the rib toward a side of the lower lid so as to support an end of the hinge. The lower lid may include at least one reinforcement rib provided at an upper surface of the lower lid so as to reinforcement strength of the lower lid. The lower lid may include a rib extended from an upper surface of the lower lid; and at least one boss provided in the rib so as to receive a fixing member.

The hinge may include: a body inserted and fixed between the lower lid and the upper lid; and a shaft extended from the body, protruded through a side of the upper lid toward an outside and rotatably connected to the case. The hinge may further include at least one hole provided at the body so as to receive a fixing member.

The lid assembly may further include at least one fixing member for penetrating and securely fixing the upper lid, the lower lid and the hinge.

In another aspect of the present invention, a lid assembly for a washing machine includes: a case having an opening at an upper end thereof; a tub provided in the case; and a lid assembly attached to an upper end of the case so as to cover/uncover the opening, the lid assembly including: an upper lid; a lower lid attached to a lower par of the upper lid; and a hinge inserted and fixed between a side of the upper lid and the lower lid and having a part extended outside of the side to then be rotatably connected to the case, wherein the upper lid and the lower lid disperse and absorb a shock generated when the lid assembly covers the opening of the case.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
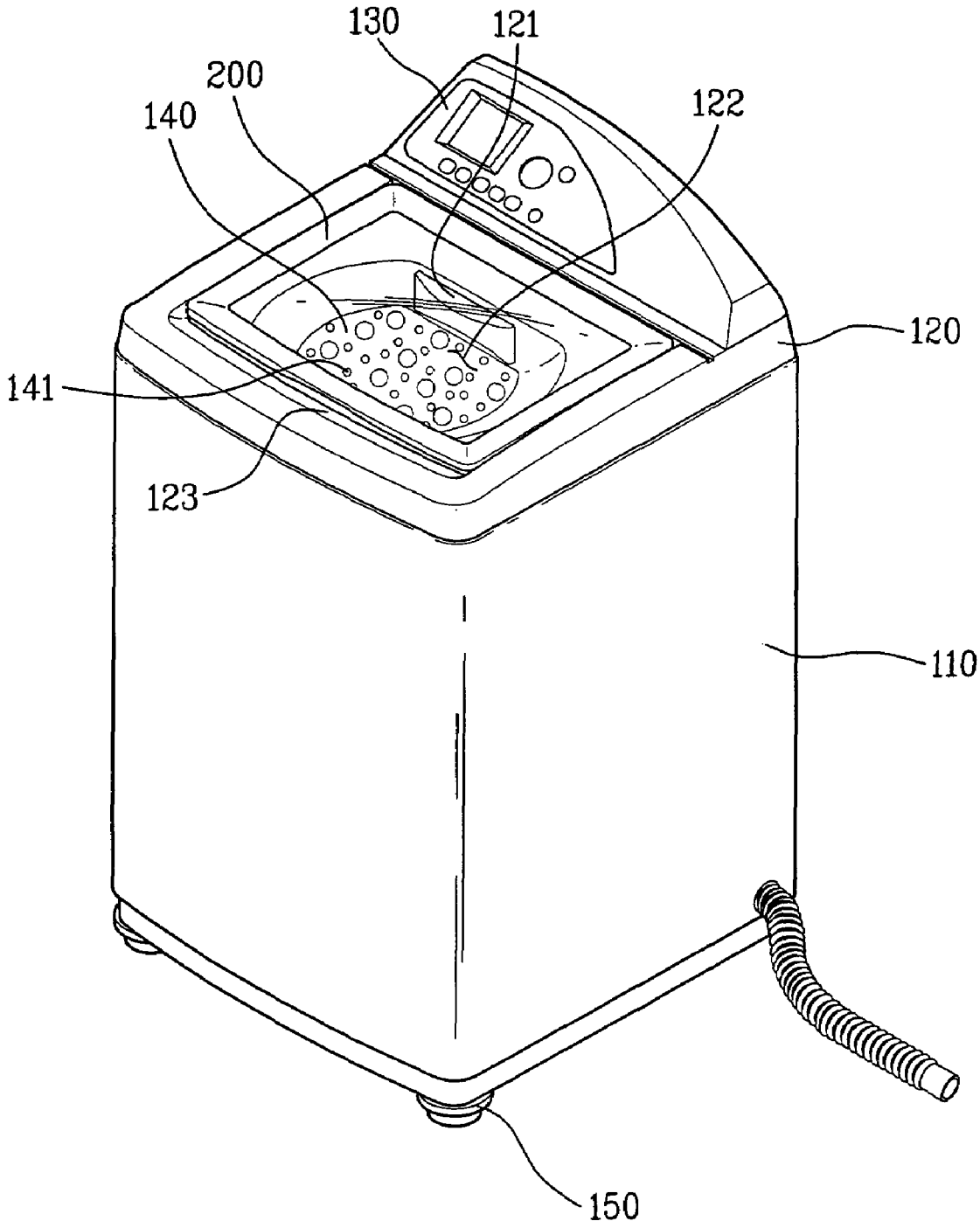
FIG. 1 is a perspective view of a washing machine according to the present invention.

FIG. 1 is a perspective view of a washing machine according to the present invention.

Referring to FIG. 1, a vertical tub (not shown) is provided in a case 110 supported by a plurality of legs 150, and a rotatable vertical drum 140 is provided in the vertical tub. A plurality of apertures 141 is formed at a periphery of the drum 140 so that washing water in the vertical tub can flow into the drum 140 as shown in FIG. 1. A pulsater (not shown) is rotatably connected to a bottom of the drum 140. Accordingly, the laundry received in the drum 140 is washed by water flow and a frictional force generated during the rotation of the pulsater and the drum 140.

A top cover 120 having an opening 122 for loading/unloading the laundry into the drum 140 is attached at a upper part of the case 110, and a control panel 130 enabling a user to handle the washing machine is attached at the top cover 120. A detergent box 121 is provided at a lower inside of the top cover 120, and washing water flowing through a water supply pipe into the washing machine passes through the detergent box 121 into the vertical tub and the drum 140. A lid assembly 200 for covering/uncovering the opening 122 is attached at the top cover 120, and a recessed portion 123 for receiving the lid assembly 200 is provided at a periphery of the opening 122.

FIGS. 2 through 8 well illustrates a structure of the lid assembly 200. The lid assembly 200 includes an upper lid 220, a lower lid 240 and a hinge 230. Hereinafter, the structure and operation of the lid assembly 200 will be described in detail with reference to FIGS. 2 through 8.

Figure 2:
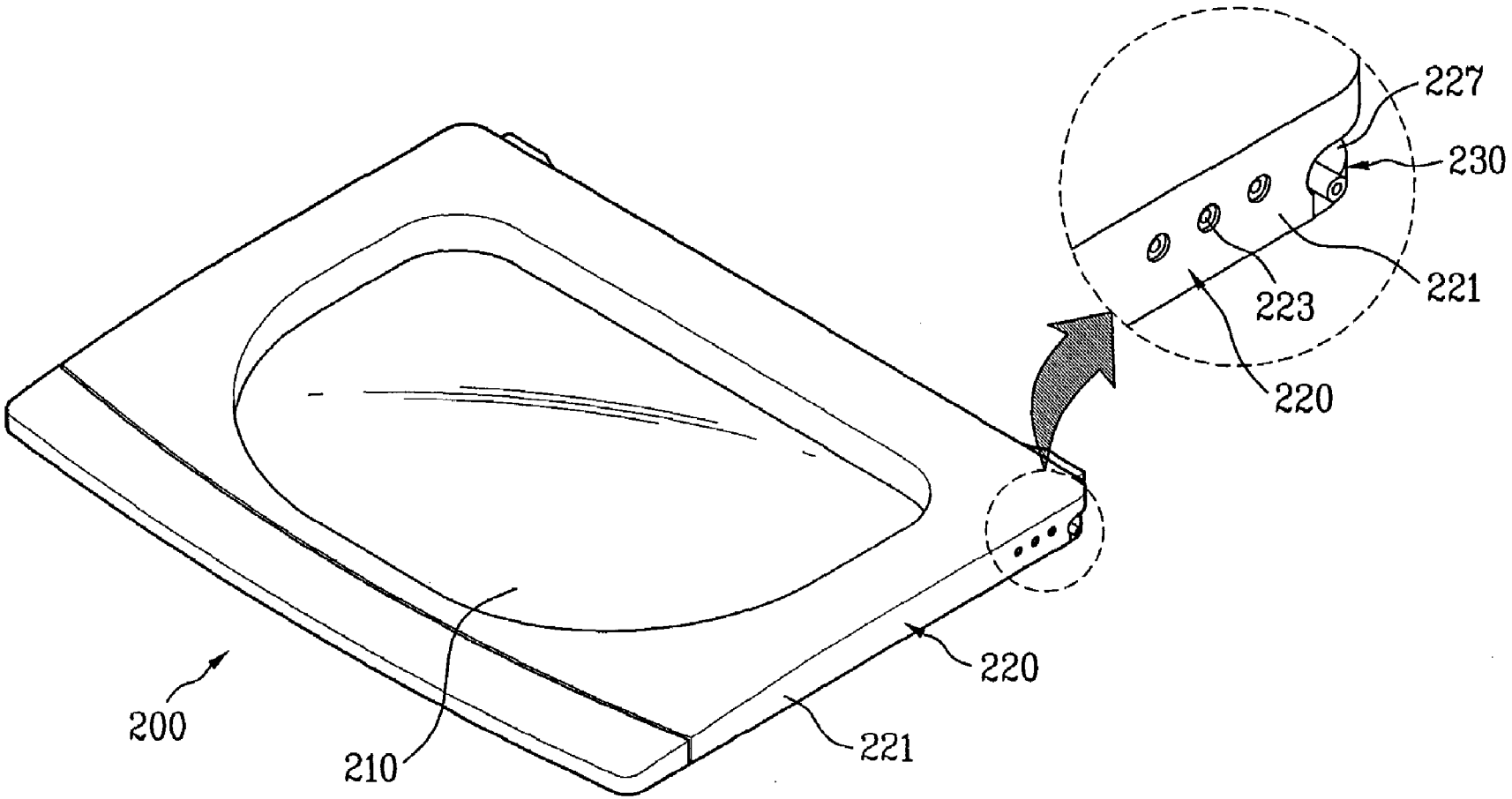
FIG. 2 is a perspective view illustrating a lid assembly of the washing machine shown in FIG. 1 according to an embodiment of the present invention.

FIG. 2 is a perspective view illustrating a lid assembly of the washing machine shown in FIG. 1 according to an embodiment of the present invention.

Figure 3:
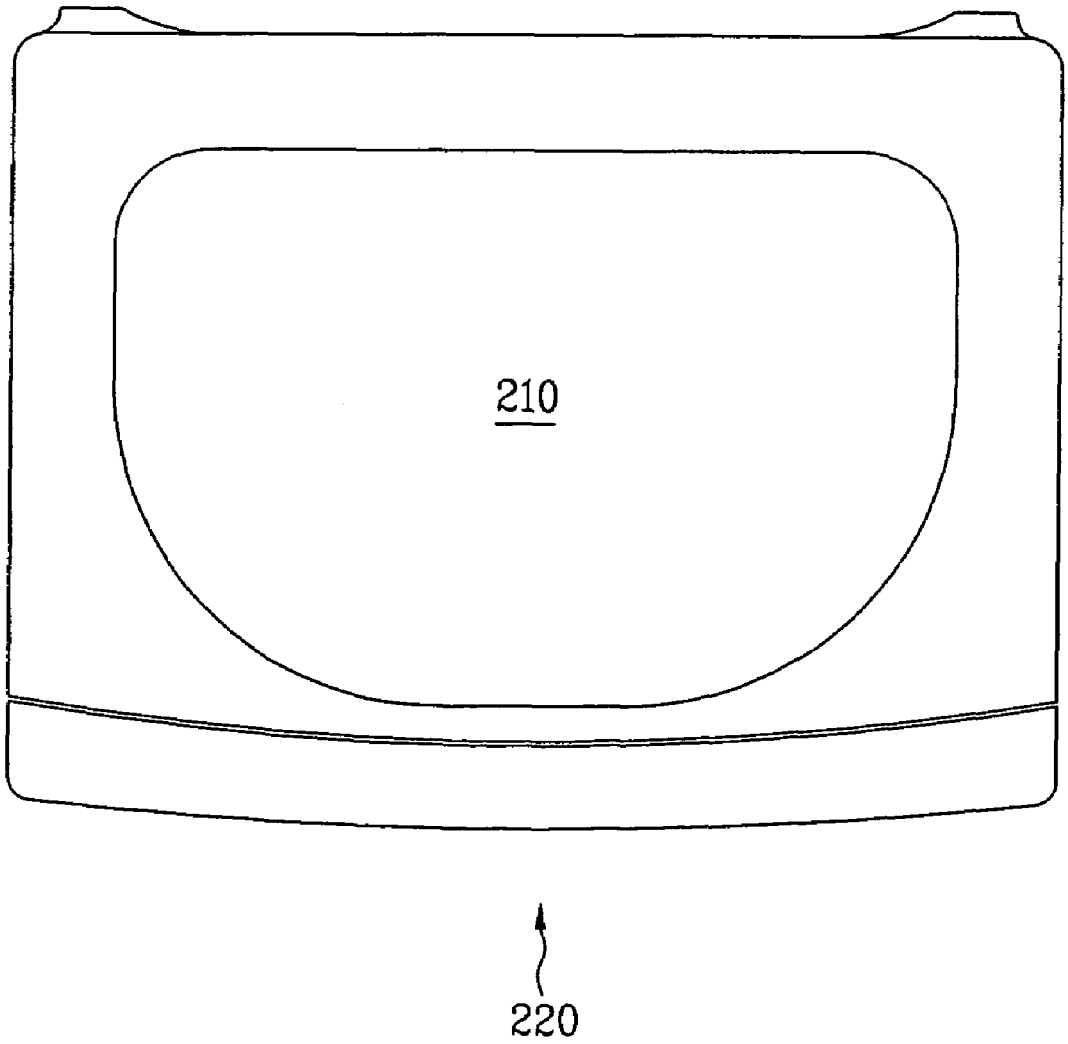
FIG. 3 is a plan view illustrating an upper surface of an upper lid in the lid assembly shown in FIG. 2.

Referring to FIG. 2, the upper lid 220 has a size capable of being received in the recessed portion 123, and a transparent window 210 is formed at a center of the upper lid 220 as shown in FIGS. 2 and 3. Accordingly, a user can view an inside of the drum 140 through window 210 during the washing process. Of course, the window 210 is provided not only at the upper lid 220 but also at the lower lid 240. The window 210 is upwardly convexed. Accordingly, water bounded from the drum 140 to a bottom surface of the window flows to an edge of the window 210 to then drop into the drum 140.

Figure 4:
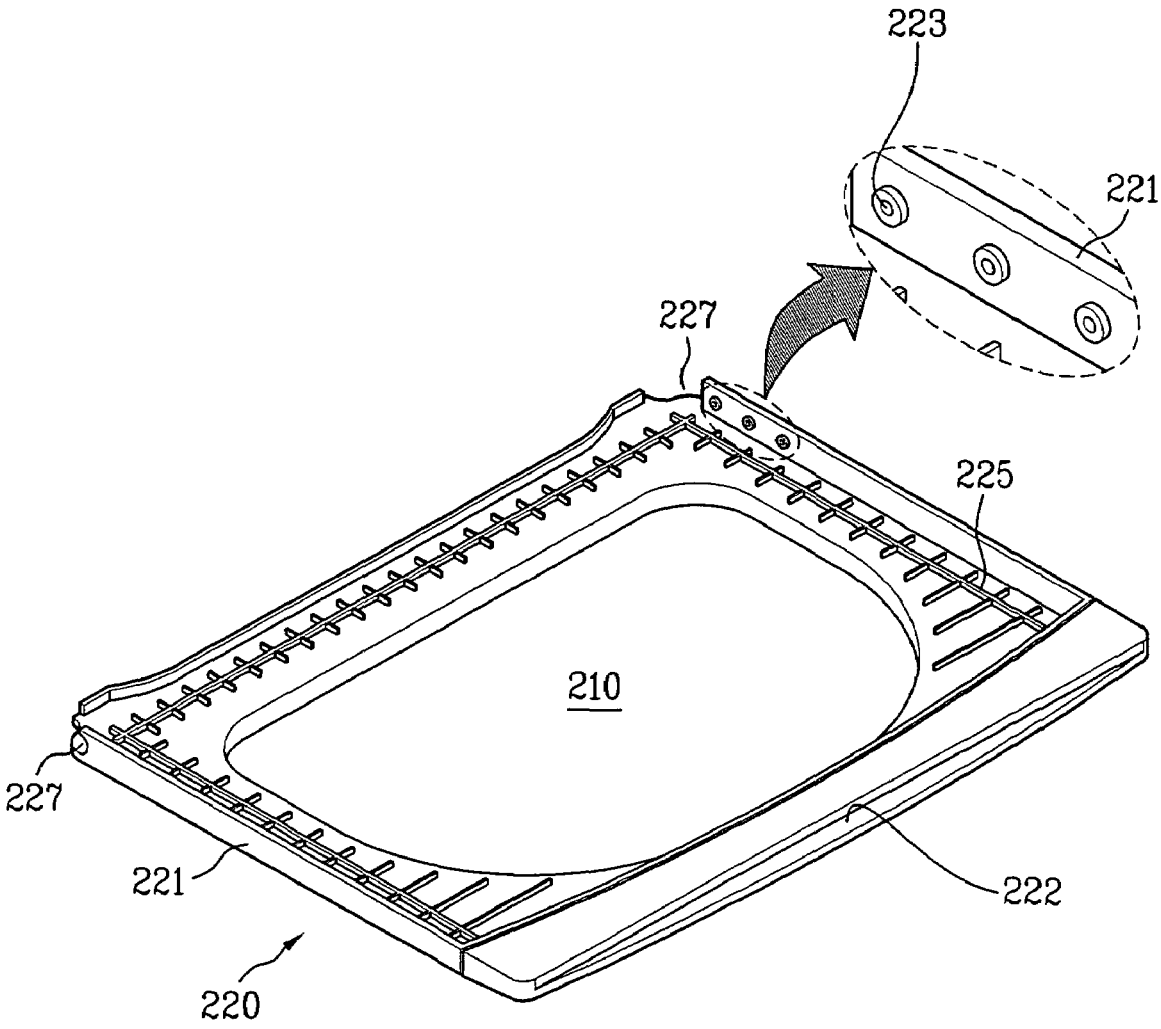
FIG. 4 is a perspective view illustrating a lower surface of the upper lid shown in FIG. 3.

A rim 221 extended downwardly from the upper lid 220 is provided at both sides of the upper lid 220. Also, at least one boss 223 for receiving a fixing member 500 is provided at the rim 221. For example, the boss 223 is positioned at a rear part of the upper lid 220, and is protruded into the upper lid 220 as shown in FIG. 4. Also, the boss 223 includes a recessed seat 223A formed at an outer surface of the rim so as to receive a head 510 of the fixing member 500.

A cut away portion 227 is provided at a part of the rim 221 positioned at a side (for example, a rear side) of the upper lid 220. Accordingly, the hinge 230 can be installed so that its some part is protruded through the cut away portion 227 toward an outside of the upper lid 220. Also, at least one reinforcement rib 225 for reinforcing strength of the upper lid 220 is provided at a lower surface of the upper lid 220 as shown in FIG. 4. For example, the reinforcement rib 225 is provided in such a way that it is formed around an edge of the upper lid 220 and surrounds the window 210.

Further, a handle, which can be griped by a user when the user opens/closes the lid assembly 200, is provided at a front part of the upper lid 220. For example, the handle may include a stepped portion 222 formed at a lower front part of the upper lid 220. Then, a user can insert his fingers into the stepped portion 222 and then can easily lift the lid assembly 200.

Figure 5:
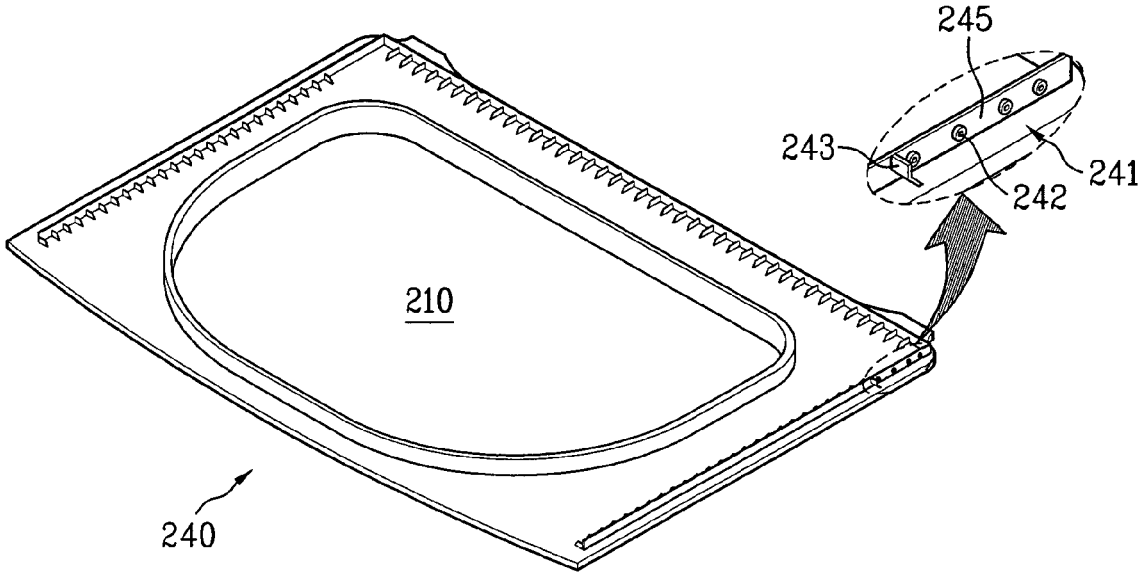
FIG. 5 is a perspective view illustrating a lower lid of the lid assembly shown in FIG. 2.

In the meantime, the lower lid 240 is connected to a lower part of the upper lid 220. As stated above, the window 210 is provided at a center of the lower lid 240, and a rib 245 is provided at an upper edge of the lower lid 240. The rib 245 is positioned at upper both sides and a rear side of the lower lid 240. Here, the rib 245 positioned at the upper both sides of the lower lib 240 is arranged spaced apart from both sides of the lower lid 240 by a given distance as shown in FIG. 5. The so-provided rib 245 reinforces strength of the lower lid 240.

Figure 7:
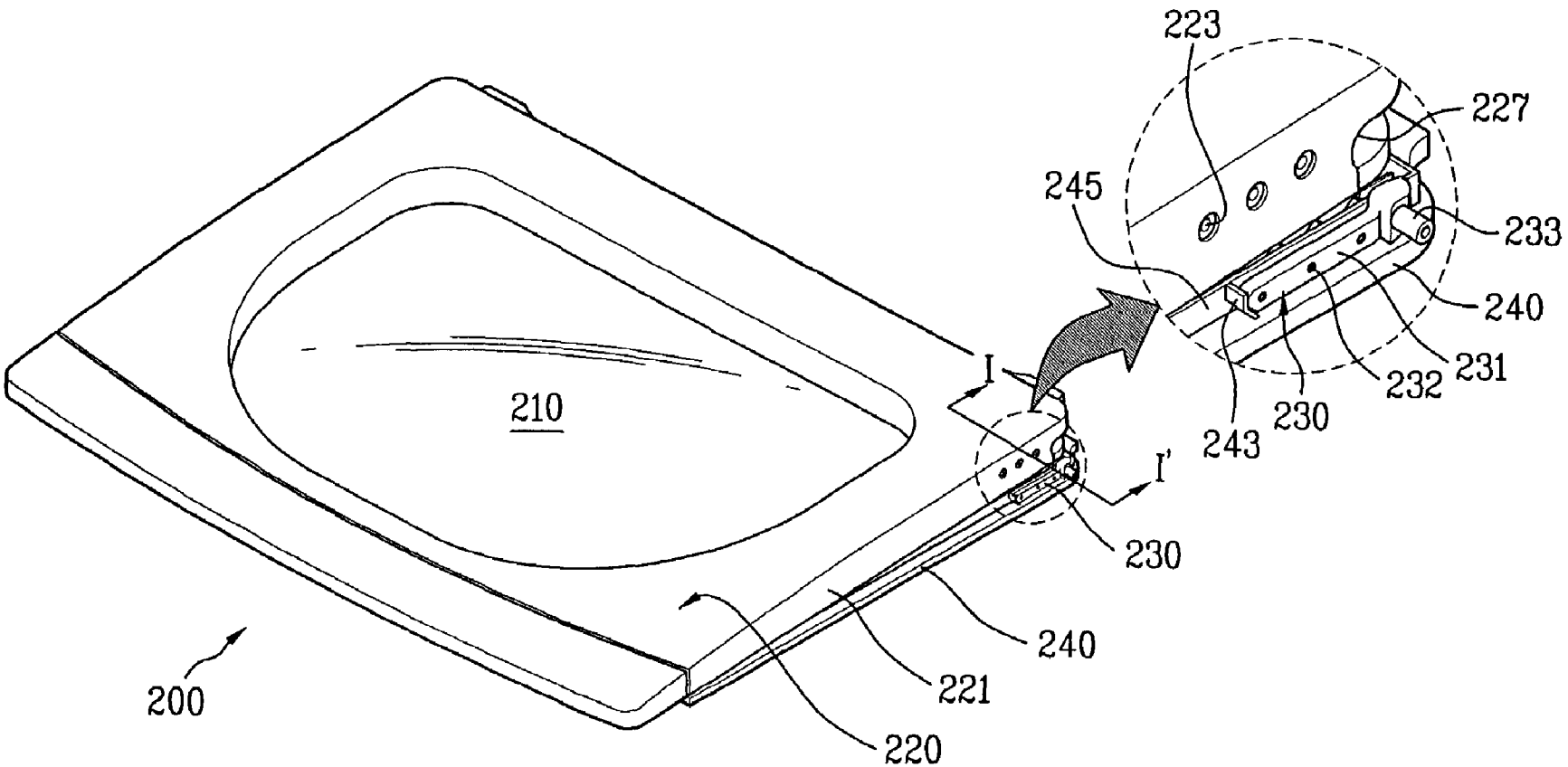
FIG. 7 is a perspective view illustrating the way how inner and upper lids and a hinge are combined in the lid assembly shown in FIG. 1.

A hinge receiving portion 241 for receiving the hinge 230 is provided at the lower lid 240. The hinge receiving portion 241 is provided at both sides of the lower lid 240, and is positioned at a rear part of the lower lid 240. Here, the hinge receiving portion 241 includes the rib 245, and a projection 243 protruded from the rib 245 toward a side of the lower lid 240. As shown in FIG. 7, the hinge 230 is seated in a space between an upper side part of the lower lid 240 and the rib 245. Accordingly, the rib 245 supports a side of the hinge 230, and the projection 243 supports an end of the hinge 230.

At least one boss 242 for receiving the fixing member 500 is provided at the lower lid 240. As shown in FIG. 5, the boss 242 is provided at the lib 245, and is positioned neighboring a rear side of the lower lid 240. The boss 242 is protruded toward an outside of the lower lid 240 as shown in FIG. 5.

Figure 6:
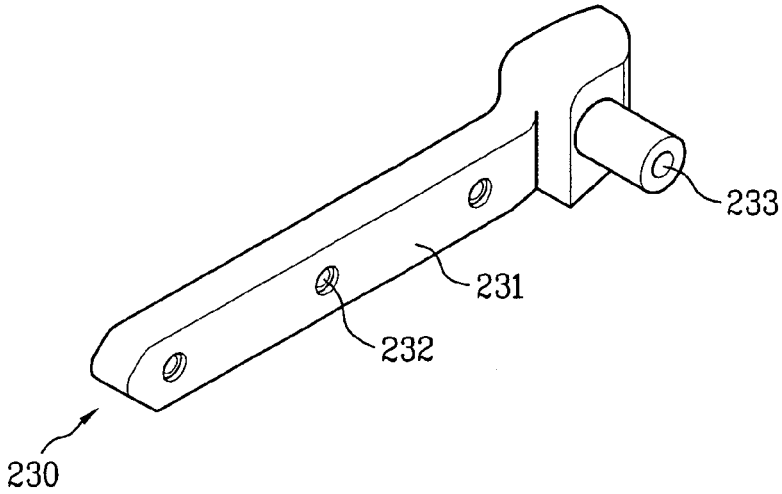
FIG. 6 is a perspective view illustrating a hinge of the lid assembly shown in FIG. 2.
Figure 8:
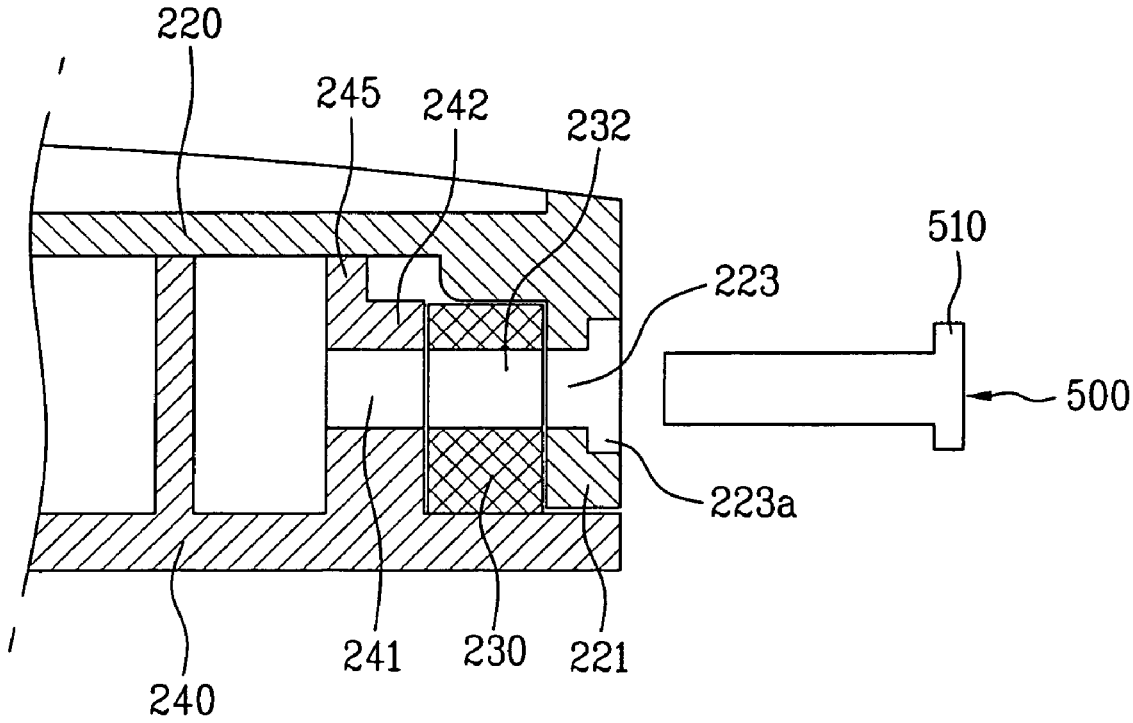
FIG. 8 is a cross-sectional view of a side taken along line I-I' in FIG. 7.

As shown in FIGS. 7 and 8, the hinge 230 is inserted between the upper lid 220 and the lower lid 240. The hinge 230 includes a body 231, and a shaft 233 extended from the body 231 as shown in FIG. 6. The body 231 is long bar-shaped, and is received in the hinge receiving portion 241 and simultaneously inserted and fixed between the upper lid 220 and the lower lid 240. Also, the shaft 233 is extended from one end of the body 231 vertically with respective to the body 231. The shaft 233 is protruded through the cut away portion 227 toward an outside of the upper lid 220, and is rotatably connected to the top cover 120 of the case 110.

As shown in FIG. 8, the upper lid 220 and the lower lid 240 and the hinge 230 is securely fixed by the fixing member 500. For this, bosses 221 and 242 are respectively provided at the upper and lower lids 220 and 240 as stated above, and the bosses 221 and 242 are faced with each other. Also, at least one hole 232 is provided at the body 231 of the hinge 230.

As shown in FIG. 8, the fixing member 500 sequentially penetrates the upper lid 220, the hinge 230 and the lower lid 240 to thereby securely fix the upper lid 220, the hinge 230 and the lower lid 240. For example, a plurality of fixing members 500 is provided, and the respective fixing members

500 penetrate the upper lid 220, the hinge 230 and the lower lid 240. In the meantime, since the head 510 for fixing the upper lid 220, the hinge 230 and the lower lid 240 is inserted into the recessed seat 223A, the head 510 of the fixing member is not exposed outside.

In the meantime, the hole 232 of the hinge 230 may be designed so that the hole 232's diameter is about the same as that of the fixing member 500. However, the present invention is not limited to this structure. For example, the hole 232 is designed so that the hole 232's diameter is about the same as those of the bosses 221 and 242, and the bosses 221 and 242 are inserted into the hole 232, and then the fixing member 500 penetrates the bosses 221 and 242 and the hole 232.

The inventive lid assembly 200 opens and closes the opening 122 at the upper side of the case 110. When the user closes the opening 122 by using the lid assembly 200, the lid assembly 200 collides with the recessed portion 123 of the case 110 while being impacted. At this time, the generated impact is equally transmitted to and absorbed by the upper lid 220 and the lower lid 240. Accordingly, an impact magnitude transmitted to the hinge 230, specifically to the shaft 233 is remarkably reduced. Accordingly, even though the washing machine is used for a long time, a drawback of destructive hinge 230 can be effectively prevented.

It will be apparent to those skilled in the art that various modifications and variations can be made in the present invention. For example, the above description provides an example in which the upper lid, the hinge, and the lower lid are mechanically connected using a fixing member. However, the present invention is not limited to this, and the upper lid, the hinge, and the lower lid can be also chemically adhered by an adhesive. Thus, it is intended that the present invention covers the modifications and variations of this invention provided they come within the scope of the appended claims and their equivalents.

What is claimed is:

1. A lid assembly for a washing machine, comprising:

an upper lid having a rim extended downwardly from both sides thereof;

a lower lid attached to a lower part of the upper lid;

a hinge inserted between the rim of the upper lid and the lower lid and having a part extended outside of the rim to then be rotatably connected to a case of the washing machine; and a fixing member for securely fixing the upper lid, the lower lid and the hinge, wherein the lower lid comprises:

a rib protruded from an upper surface of the lower lid and positioned spaced apart from a side of the lower lid by a given distance so as to receive the hinge;

a projection protruded from the rib toward the side of the lower lid so as to support an end of the hinge; and at least one boss provided at the rib so as to receive the fixing member.

2. The lid assembly of claim 1, wherein the upper lid comprises:

at least one boss provided in the rim so as to receive the fixing member; and a cut away portion provided at a side of the upper lid so that the part of the hinge is protruded therethrough.

3. The lid assembly of claim 1, wherein the hinge comprises:

a body inserted and fixed between the lower lid and the upper lid;

a shaft extended from the body, protruded through a side of the upper lid toward an outside and rotatably connected to the case; and at least one hole provided at the body so as to receive the fixing member.

* * * * *